US009407001B2

(12) United States Patent
Nilsson

(10) Patent No.: US 9,407,001 B2
(45) Date of Patent: Aug. 2, 2016

(54) ANTENNA ASSEMBLY

(71) Applicant: Jack Nilsson, Canton, OH (US)

(72) Inventor: Jack Nilsson, Canton, OH (US)

(73) Assignee: Jack Nilsson, Canton, OH (US)

( * ) Notice: Subject to any disclaimer, the term of this patent is extended or adjusted under 35 U.S.C. 154(b) by 284 days.

(21) Appl. No.: 13/944,531

(22) Filed: Jul. 17, 2013

(65) Prior Publication Data

US 2014/0022144 A1 Jan. 23, 2014

Related U.S. Application Data

(60) Provisional application No. 61/741,346, filed on Jul. 18, 2012.

(51) Int. Cl.
*H01Q 1/36* (2006.01)

(52) U.S. Cl.
CPC ..... *H01Q 1/36* (2013.01); *Y10T 29/49016* (2015.01)

(58) Field of Classification Search
CPC ..... H01Q 1/36; H01Q 9/27
USPC ..... 343/895
See application file for complete search history.

(56) References Cited

U.S. PATENT DOCUMENTS 2,850,732 A 9/1958 Kandoian et al.
2,856,605 A * 10/1958 Jacobsen ..... 343/895
3,131,394 A * 4/1964 Wheeler ..... 343/895
4,527,163 A 7/1985 Stanton
4,630,064 A * 12/1986 Andrews et al. ..... 343/895
5,592,150 A * 1/1997 D'Hont ..... 343/895
6,339,409 B1 1/2002 Warnagiris
7,639,203 B2 12/2009 Hao
7,825,873 B2 11/2010 Fond et al.
2012/0026051 A1 2/2012 Nilsson

OTHER PUBLICATIONS

Computer Model for a Towed Submarine Communication Antenna, Gary A. Ulrich, Submitted to the Department of Ocean Engineering on May 13, 1993, in partial fulfillment of the requirements for the degree of Naval Engineer Master of Science, Mechanical Engineering.

Zhi Ning Chen "Broadband Roll Monopole" IEEE Transactions on Antennas and Propagation, vol., 51, No. 11, Nov. 2003, pp. 3175-3177.

* cited by examiner

*Primary Examiner* — Hoang V Nguyen
*Assistant Examiner* — Michael Bouizza
(74) *Attorney, Agent, or Firm* — Eschweiler & Associates, LLC

(57) ABSTRACT

The present invention relates to an antenna assembly for transmitting and receiving electromagnetic waves. More particularly, this invention relates to a wideband and multiband omnidirectional antenna assembly for sending and receiving radio waves. Specifically, this invention relates to a radiative antenna element formed by way of a single-fed spiraled sheet of conductive material. The conductive material is interlaced with a dielectric material to form the radiative element. The radiative element includes a height of substantially less than ¼ of the characteristic wavelength of the lowest operating frequency.

6 Claims, 4 Drawing Sheets

ANTENNA ASSEMBLY

CROSS-REFERENCE TO RELATED APPLICATION

This application claims priority from U.S. Provisional Application Ser. No. 61/741,346, filed Jul. 18, 2012, the disclosure of which is incorporated herein by reference.

BACKGROUND OF THE INVENTION

1. Technical Field

This invention relates to a device for transmitting and receiving electromagnetic waves. More particularly, this invention relates to a wideband and multiband omnidirectional antenna for sending and receiving radio waves. Specifically, this invention relates to a radiative antenna element formed by way of a single-fed spiraled sheet of conductive material interlaced with a dielectric material and having a height of markedly less than ¼ of the characteristic wavelength of the lowest operating frequency.

2. Background Information

Heretofore, different coil geometries have been used for antenna designs. Examples include helical coil variations, including those found in U.S. Patent Application Publication No. 2012/0026051 to Nilsson (hereinafter "Nilsson"). The disclosure of Nilsson and prior art coiled antennas all suffer from the same defects of a large size relative to their intended frequency use and narrow banded qualities. The uncoiled length of these prior art coiled antennas are all over ¼ of the characteristic of the lowest operating frequency of the antenna. Further, these prior art antennas are defined for one frequency band and are narrow banded even on that single band, Prior art antennas include a substantially long stem or stems and/or a large diameter, including those found in U.S. Pat. Nos. 2,850,732, 7,639,203 and U.S. Pub. No. 2012/0026051. As such, conventional coiled antennas are large and bulky and/or operate at a very narrow band. Thus, there is a tremendous need in the art to condense the size of coiled antennas while also increasing the bandwidth.

BRIEF SUMMARY OF THE INVENTION

One aspect of the invention includes an antenna assembly comprising: a cable having a lead; a radiative element having a height and connected to the lead for sending and receiving electromagnetic signals; wherein the radiative element includes a spirally wound sheet of conductive material having a length and a width; and wherein the height of the radiative element is equal to the width of the sheet of conductive material.

Another aspect of the invention includes a method for forming an antenna assembly having a characteristic wavelength associated with a lowest operating frequency of the antenna assembly, the method comprising the steps of: forming a sheet of first material, wherein the sheet of first material extends from a first end to a second end; connecting a lead to the sheet of first material; rolling the sheet of first material about the first end to form a spiraled radiative element; and sending and receiving electromagnetic signals via the radiative element.

Another aspect of the invention includes a method of forming a wideband and multiband omnidirectional antenna, the method including the steps of: rolling a sheet of conductive material about an end of the sheet; preventing the conductive material from contacting itself; and wherein the rolled sheet is adapted to be connected to a lead to facilitate sending and receiving electromagnetic signals.

BRIEF DESCRIPTION OF THE SEVERAL VIEWS OF THE DRAWINGS

Preferred embodiments of the invention, illustrated of the best mode in which Applicant contemplates applying the principles, are set forth in the following description and are shown in the drawings and are particularly and distinctly pointed out and set forth in the appended claims.

Similar numbers refer to similar parts throughout the drawings.

DETAILED DESCRIPTION OF THE INVENTION

The compact wide-band/multi-band omnidirectional antenna assembly of the present invention is shown in FIGS. 2-8, and is indicated generally at 1. Antenna assembly 1 is used for transmitting and receiving radio frequency signals in accordance with various aspects of the present invention.

Figure 1:
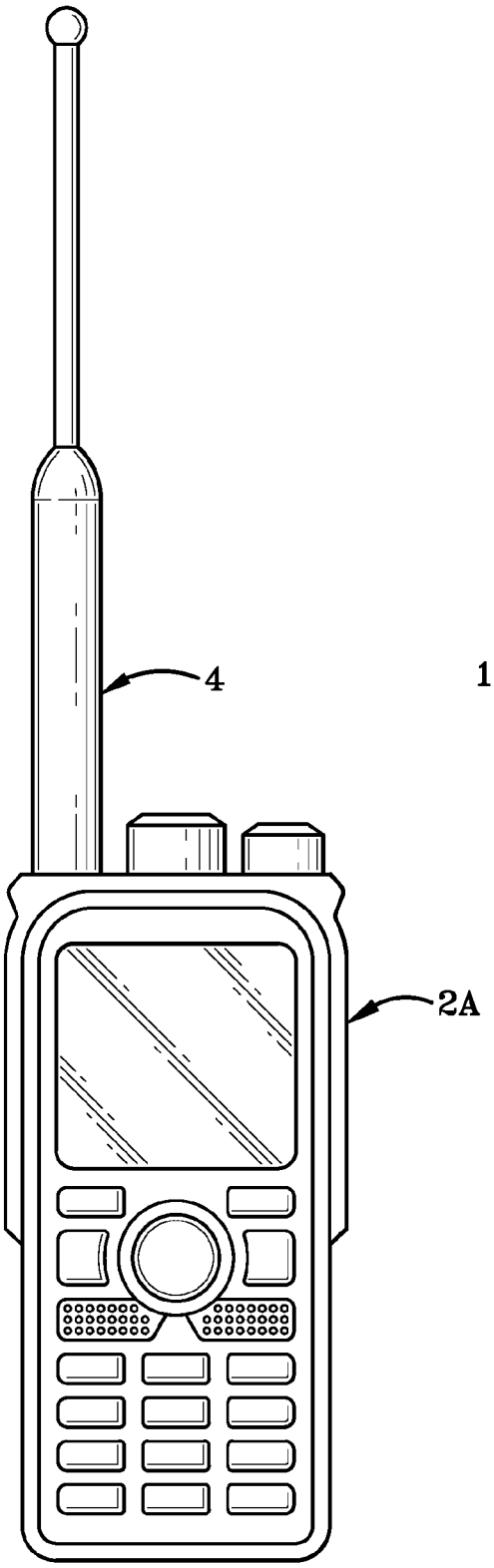
FIG-1 PRIOR ART
FIG. 1 is an elevational view of a prior art handheld radio unit having a prior art antenna extending therefrom.
Figure 2:
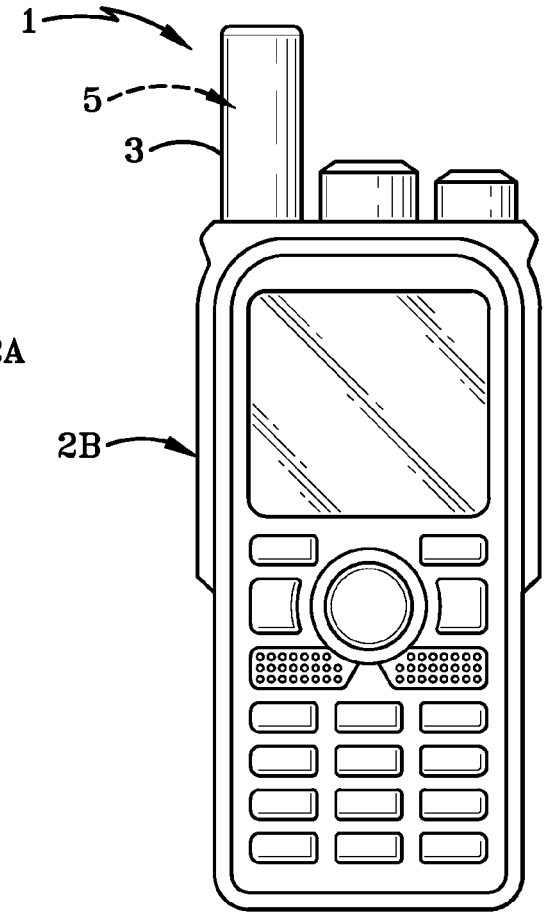
FIG. 2 is an elevational view of the present invention connected to a handheld radio unit and covered with a protective radome.

As shown in FIGS. 1 and 2, antenna assembly 1 is a smaller alternative to prior art antennas for comparable intended frequencies, as the prior art antennas include a much larger profile while radiating within a smaller frequency band. A comparison with the prior art is shown in FIGS. 1 and 2, wherein FIG. 1 includes a handheld radio 2A supplied with a prior art antenna assembly 4. Antenna assembly 4 is lengthy and radiates within a narrow band spectrum. As shown in FIG. 2, antenna assembly 1 is generally much smaller and compact yet radiates within a wider band, even when a radome 3 is included in antenna assembly 1. Thus, handheld radio 2B is more compact while providing better frequency coverage. For another comparison (not shown), military vehicles employ ten foot or longer antennas known as "whips," which are typically pulled back and tied to the vehicle because of their length. The extreme length of these antennas is required in conventional designs in order to transmit/receive at the designated military frequency of 30-512 MHz. When the present invention is configured to operate in this 30-512 MHz military frequency band, the resulting antenna assembly 1 is approximately two feet in length, rather than the ten feet or longer currently required.

Figure 3:
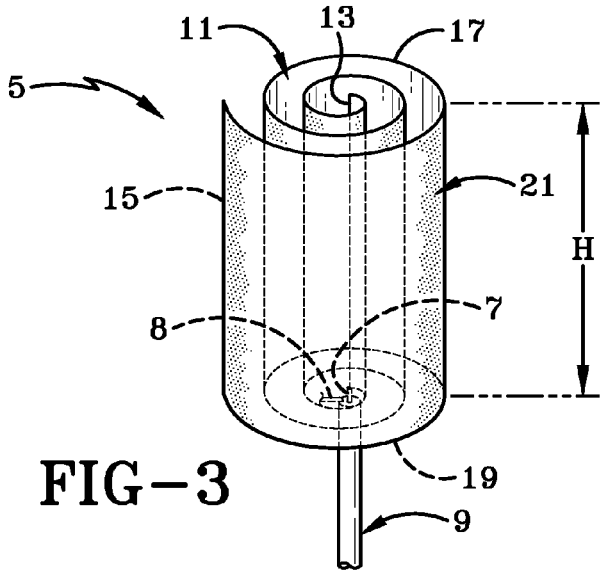
FIG. 3 is a perspective view of the present invention having the radome removed.
Figure 4:
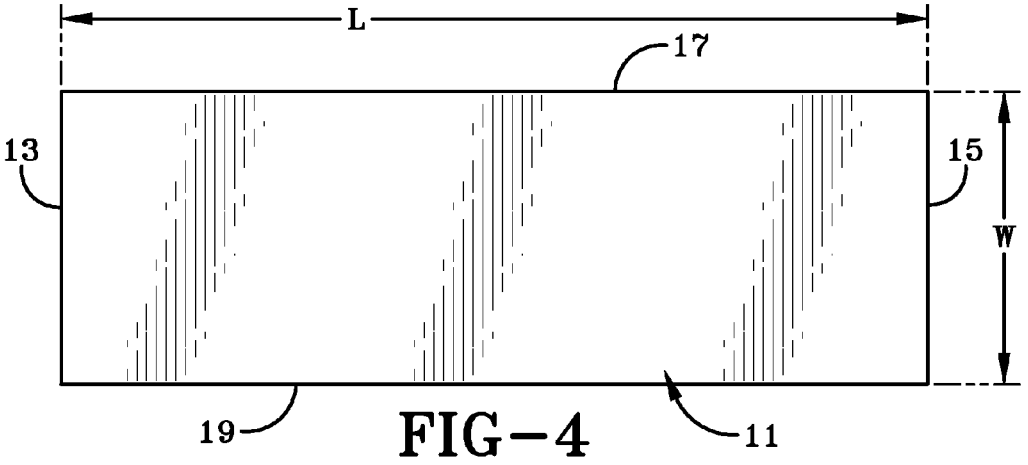
FIG. 4 is an elevational view of a sheet of material used in the present invention.

As shown in FIG. 3, antenna assembly 1 includes a radiative element 5 which is single-fed and connected to a lead 7, wherein lead 7 is enclosed in a cable 9. Cable 9 may also include another lead 8 for use in connecting to a similar additional radiative element, a ground plane, or any other type of counterpoise. Radiative element 5 is scroll shaped having a spiraling orientation and multiple layers wrapping around itself, generally about the longitudinal axis of cable 9. Radiative element 5 is formed from a flat, generally rectangular sheet of material, shown in FIG. 4 and referred to hereinafter as sheet 11. Sheet 11 extends from a first end 13 to a second end 15 and includes a first side 17 and a second side 19. Sheet 11 further includes a length L and a width W. While sheet 11 is shown in FIG. 4 as conforming to a proper rectangular shape, sheet 11 may include tapering at any one or more of the ends or sides or any of the dimensional areas of sheet 11. Further, sheet 11 may be formed in any other polygonal shape, including hexagon or decagon shape.

Figure 5:
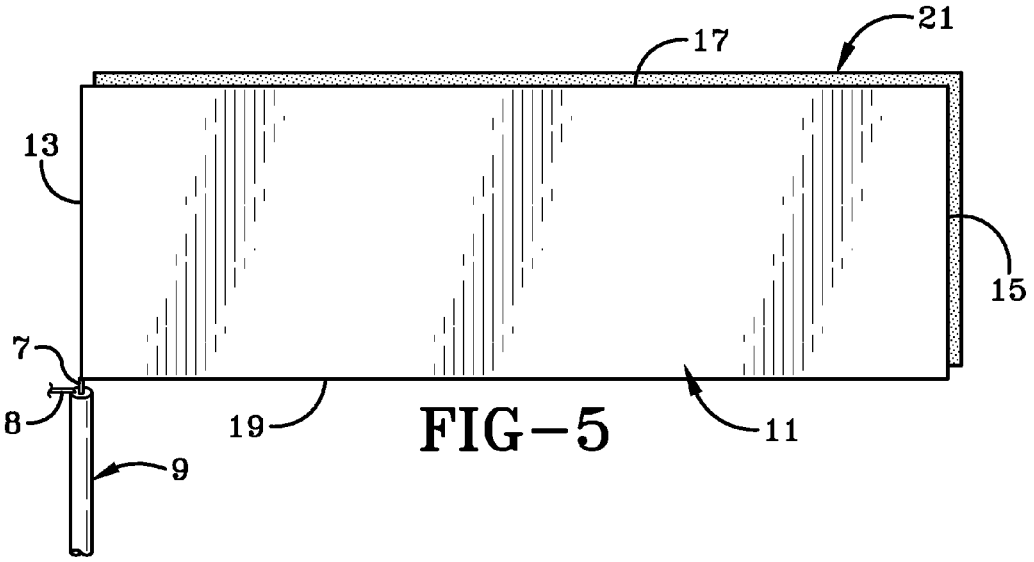
FIG. 5 is a perspective view of an unspiraled radiative element of the present invention.

As shown in FIG. 5, sheet 11 is combined with another generally rectangular sheet of material, referred to hereinafter as sheet 21. Sheet 21 generally follows the shape of sheet 11. However, sheet 21 may be configured to incorporate a separate or different shape from sheet 11. Sheet 11 and sheet 21 may be combined by gluing the two sheets together or by dipping sheet 11 in the material used to form sheet 21, or any other method of combining sheet 11 and sheet 21. Further, sheet 21 may be any other style of spacing material used for spacing the individual windings of sheet 11 and prevent abutment of sheet 11 with itself. Fluids such as air are also contemplated and may be utilized as a spacing material to prevent sheet 11 from contacting itself.

As shown in FIGS. 3 and 5, sheet 11 and sheet 21 are spiraled about first end 13 to form the overall scroll shape of radiative element 5. Sheet 11 and sheet 21 are interlaced to form radiative element 5, whereby the spiraling sheet 11 is disposed between the spiraling sheet 21. Radiative element 5 includes a height H which generally equal to width W, as sheet 11 and sheet 21 are spiraled about first end 13 which defines width W. Sheet 11 may be conductive and sheet 21 may be dielectric or non-conductive. As such, a short circuit is avoided by interlacing the dielectric material of sheet 21 between the conductive material of sheet 11 throughout the spiral of radiative element 5.

Figure 6:
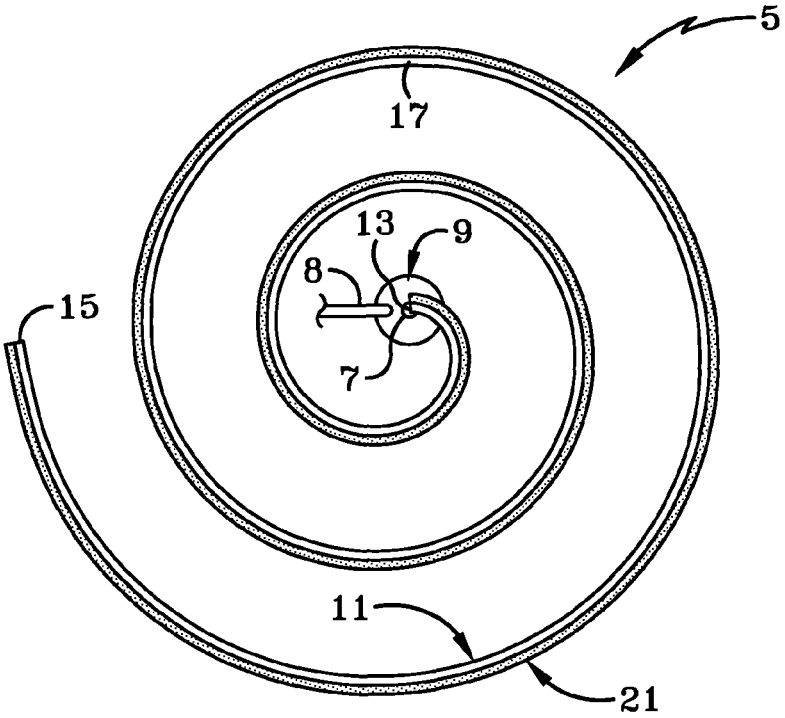
FIG. 6 is a top view of the present invention showing a circular spiraling of the radiative element.
Figure 7:
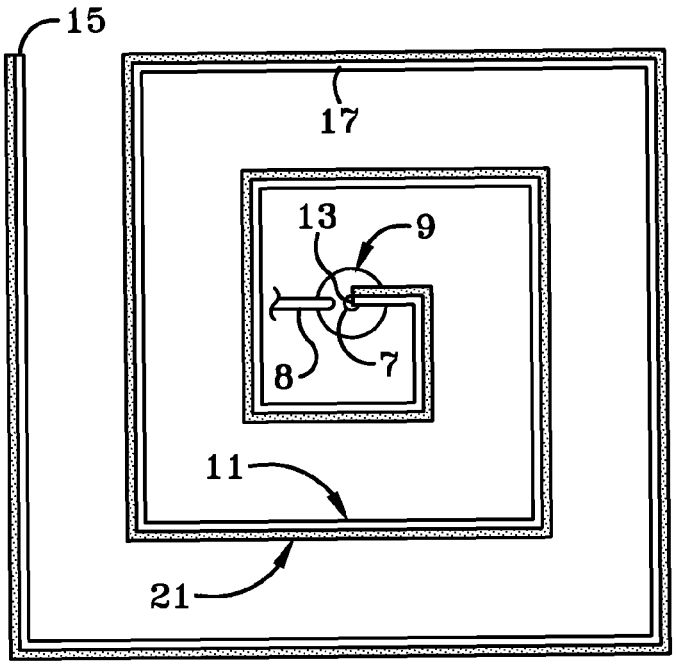
FIG. 7 is a top view of another embodiment of the present invention showing a right angled spiraling of the present invention.

As shown in FIG. 6, the cross-sectional shape of radiating element 5 is generally circular, whereby sheet 11 and sheet 21 spiral outwardly from first end 13 in an arcuate manner. Alternatively, sheet 11 and sheet 21 may spiral outwardly from first end 13 using right-angle turns as the spiral winds around or wraps on itself. This provides a generally rectangular cross-sectional shape for radiating element 5. However, while a circular cross-sectional shape (FIG. 6) and a rectangular cross-sectional shape (FIG. 7) are shown, any method of spiraling sheet 11 and sheet 21 about first end 13 is encompassed by the present invention. FIG. 6 depicts sheet 11 and sheet 21 spaced a distance apart throughout the coils or spirals. In practice, these coils or spirals are typically abutting the previous/next spiral in a tightly wound fashion. FIG. 6 is an exemplary embodiment purposely expanded to show the spiraling nature of radiative element 5.

As shown in FIG. 4, width W is less than length L. The preferred embodiment of sheet 11 includes configuring width W to measure about 10-25% of length L. It has been found that a width of between 10% and 25% yields the most beneficial transmitting and receiving pattern, including a signal pattern having wideband and multiband omnidirectional characteristics. As such, antenna assembly 1 produces a wideband characteristic despite its compact size, as width W of sheet 11 is equal to height H of radiating element 5.

Further, one familiar with the art will readily understand that for any given embodiment of antenna assembly 1, radiating element 5 operates with a characteristic wavelength associated with a lowest operating frequency of radiating element 5. In accordance with one aspect of the present invention, length L is less than ¼ wavelength of the characteristic wavelength associated with the lowest operating frequency. Prior art designs all conform to an unwound length of always substantially greater than ¼ wavelength of their lowest operating frequency. The present invention provides for a wider operating band by decreasing the unwound length L of sheet 11 to be less than ¼ wavelength. This also conserves materials and power and decreases the overall diameter of radiating element 5, allowing for a smaller antenna assembly 1 when compared to contemporary designs.

Figure 8:
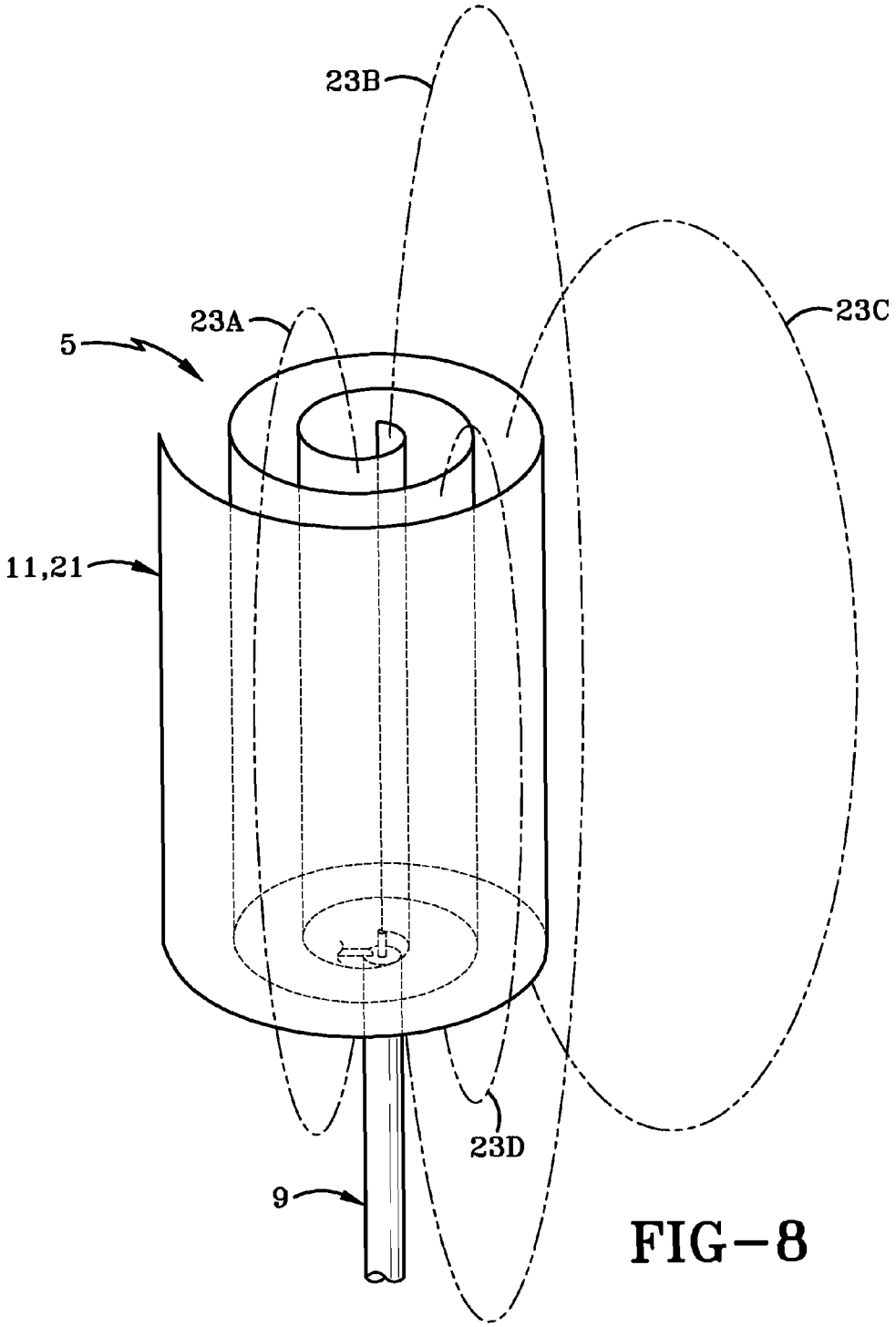
FIG. 8 is a perspective view of the present invention showing various magnetic fields being emitted from various high current portions of the radiative element.

As shown in FIG. 8, antenna assembly 1 emits a plurality of magnetic fields 23 at different high current portions at different frequencies of spiraled sheet 11. These different magnetic fields as well as a variety of electric field hot voltage points at different frequencies provide for the multiple different frequencies coverage achieved by antenna assembly 1. See the differing magnetic fields 23A, 23B, 23C, and 23D of FIG. 8. These magnetic fields 23 are substantially vertically polarized. There is variance in the electric fields at different frequencies depending on counterpoise used, which may be a ground plane configuration or a similar ground-connected coil. This provides for the increased bandwidth and multiple bands which are provided in a substantially overall omnidirectional manner by antenna assembly 1.

By way of an example, in an exemplary embodiment of the present invention intended be received by handheld radio unit 2 of FIG. 2, length L of sheet 11 is approximately 15 inches, whereas width W of sheet 11 is approximately 2.75 inches. As such, W is in the 10% to 25% range of L at approximately 18%. Also in the exemplary embodiment, sheet 11 is formed of a copper material and is spirally wound about first end 13 with about seven winds having approximately $5/64^{th}$ of an inch between the individual winds. The resultant radiative element 5 is approximately 2.75 inches high and about 1.125 inches in diameter. The exemplary embodiment further connects second lead 8 to the ground of handheld radio 2B for use as a counterpoise. A radiative element 5 formed to include these parameters yields a much greater than expected performance at 136-174 MHz, 380-520 MHZ, 746-869 MHz, and 1575 MHz (G.P.S. signals). This performance rivals much longer and more complex antennas and represents an enormous improvement in the art.

In other embodiments ground plane 13 may be for example the sheet metal of a roof of a building or of a vehicle, and may be even larger with similar benefits.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An antenna assembly comprising:

a cable having a lead;

solely a single radiative element having a height and connected to the lead for sending and receiving electromagnetic signals;

wherein the radiative element includes a spirally wound sheet of conductive material having a length and a width; and wherein the height of the radiative element is equal to the width of the sheet of conductive material, and wherein the height is between 2.5% and 6% of the wavelength of an operating frequency of the antenna assembly.

2. The antenna assembly of claim 1, wherein the radiative element further includes a dielectric material, and wherein the dielectric material prevents the sheet of conductive material from contacting itself.

3. The antenna assembly of claim 1, wherein the radiative element further includes a spirally wound sheet of dielectric material, and wherein the sheet of dielectric material prevents the sheet of conductive material from contacting itself.

4. The antenna assembly of claim 3, wherein the sheet of dielectric material is adhered to the sheet of conductive material.

5. The antenna assembly of claim 1, wherein the width of the conductive sheet is between 10% and 25% of the length.

6. The antenna assembly of claim 1, wherein the cable further includes a second lead, and wherein the second lead is connected to one of a ground plane and a coiled antenna.

* * * * *